US006021655A

United States Patent [19]

Labbe et al.

[11] Patent Number: 6,021,655

[45] Date of Patent: Feb. 8, 2000

[54] INTERCHANGEABLE CORE LOCK REPINNING APPARATUS

[75] Inventors: Robert A. Labbe, Woodbury; Gerald G. Roraback, Jr., Litchfield, both of Conn.

[73] Assignee: Lab Security Systems Corporation, Bristol, Conn.

[21] Appl. No.: 09/237,360

[22] Filed: Jan. 26, 1999

[51] Int. Cl.[7] ..... E05B 27/04

[52] U.S. Cl. ..... 70/493; 29/281.1; 29/804; 70/372; 70/385; 70/431; 70/DIG. 44

[58] Field of Search ..... 70/372, 375, 382–385, 70/394, 431, 493, 494, DIG. 15, DIG. 44, DIG. 75; 29/804, 251, 281.1; 33/539, 540

[56] References Cited

U.S. PATENT DOCUMENTS

| | | | |
|---|---|---|---|
| 271,962 | 2/1883 | White | 70/493 |
| 952,787 | 3/1910 | Crawford . | |
| 988,663 | 4/1911 | Rees | 70/DIG. 75 X |
| 1,004,904 | 10/1911 | Rees | 70/382 |
| 1,113,193 | 10/1914 | Carroll | 70/493 X |
| 1,135,027 | 4/1915 | Kohlberger | 70/DIG. 75 X |
| 1,513,718 | 10/1924 | Morehouse | 70/385 |
| 1,937,165 | 11/1933 | Piagneri | 70/493 X |
| 2,105,659 | 1/1938 | Jacobi . | |
| 2,887,918 | 5/1959 | Benson . | |
| 3,002,268 | 10/1961 | Spain . | |
| 3,111,748 | 11/1963 | Doll et al. | 29/804 X |
| 3,218,699 | 11/1965 | Maese . | |
| 3,417,452 | 12/1968 | Roland . | |
| 3,985,010 | 10/1976 | Idoni | 70/378 X |
| 3,987,654 | 10/1976 | Iaccino et al. | 70/378 X |
| 4,116,026 | 9/1978 | Flint | 70/383 |
| 4,123,926 | 11/1978 | Elder | 70/369 |
| 4,185,482 | 1/1980 | Nail | 70/394 |
| 4,305,314 | 12/1981 | Simpson | 81/3 R |
| 4,391,112 | 7/1983 | Neyret | 70/493 |
| 4,517,746 | 5/1985 | Easley | 33/549 |
| 4,531,389 | 7/1985 | Foshee | 70/372 |
| 4,531,390 | 7/1985 | Best et al. | 70/372 |
| 4,616,394 | 10/1986 | Best et al. | 29/436 |
| 4,663,839 | 5/1987 | Foshee | 29/804 |
| 4,667,494 | 5/1987 | Joosten | 70/394 |
| 4,675,994 | 6/1987 | Detloff | 29/804 |
| 4,680,860 | 7/1987 | Detloff | 29/804 |
| 4,680,870 | 7/1987 | McConnell | 33/540 |
| 5,168,734 | 12/1992 | Duval et al. | 70/369 |

FOREIGN PATENT DOCUMENTS

| | | | |
|---|---|---|---|
| 816803 | 11/1951 | Germany | 70/493 |
| 109232 | 8/1966 | Norway | 70/493 |
| 996704 | 2/1983 | U.S.S.R. | 70/372 |

*Primary Examiner*—Lloyd A. Gall

*Attorney, Agent, or Firm*—St. Onge Steward Johnston & Reens LLC

[57] ABSTRACT

An all-in one tool usable by the locksmith in servicing of interchangeable core locks, for lock pin removal and decoding, and lock core repinning and recapping. The tool comprises a body having a central core receiving channel extending therethrough; a plurality of cylindrical bores extending through the body and perpendicularly intersecting the core receiving channel; and a receptacle receiving channel in the body located below and in communication with the core receiving channel; and a removable pin receiving receptacle slidably received in the receptacle receiving channel. The pin receiving receptacle has a plurality of pin receiving pockets extending perpendicularly from the core receiving channel of the body generally in alignment with the cylindrical bores. The pin receiving receptacle may take either of two forms: a hinged form that opens like a book to reveal the captured lock pins, or a solid block form that contains slots in which the captured pins are visible.

17 Claims, 2 Drawing Sheets

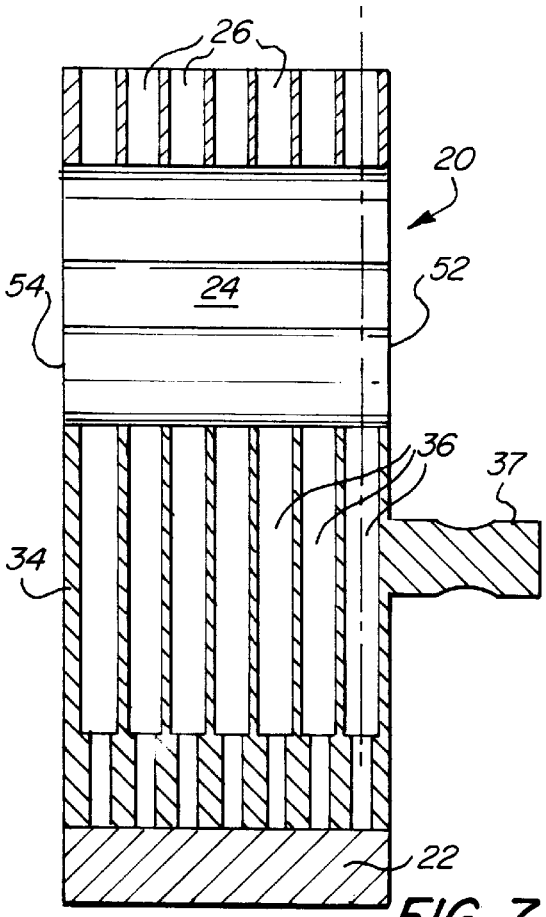
FIG. 7
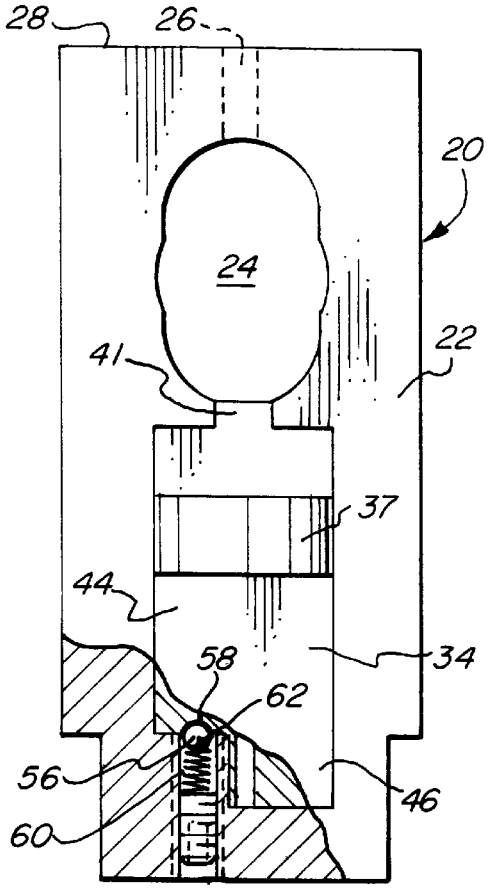
FIG. 6
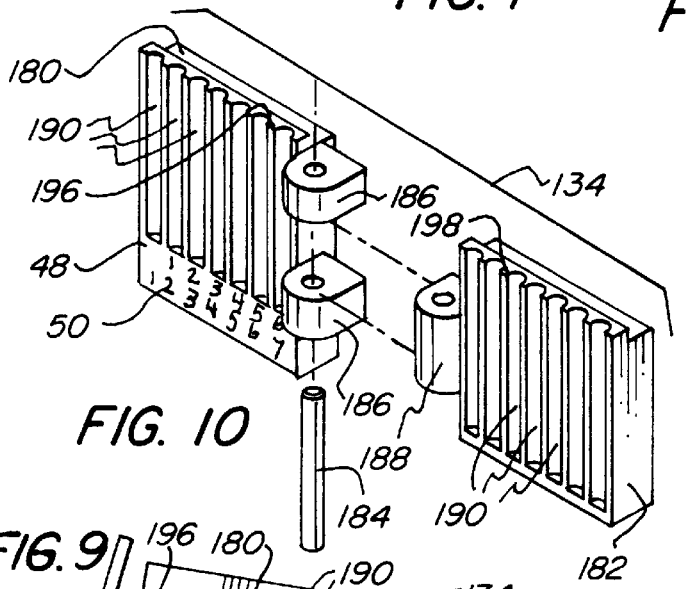
FIG. 10
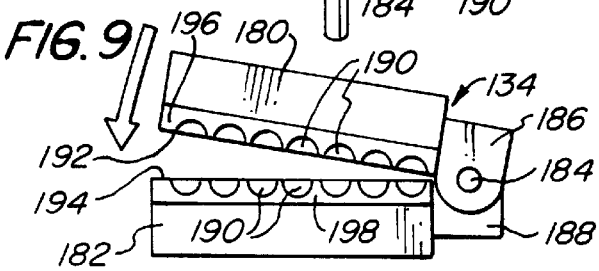
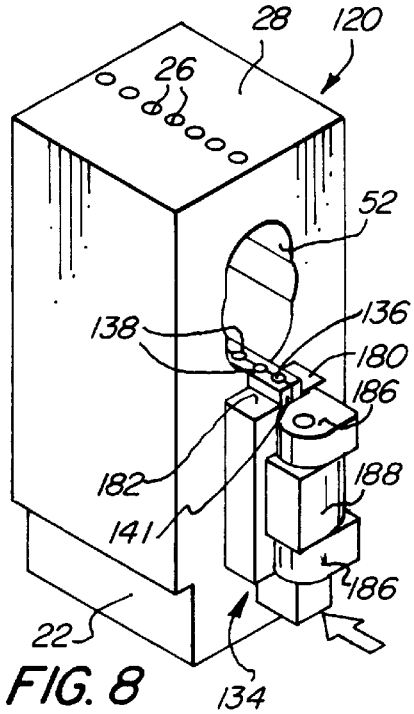
FIG. 8

INTERCHANGEABLE CORE LOCK REPINNING APPARATUS

FIELD OF THE INVENTION

The present invention relates to the field of locksmithing, and particularly to apparatus for repinning interchangeable core locks to accept different keys, and decoding of the interchangeable core to identify the control pins.

BACKGROUND OF THE INVENTION

There are many instances where it is necessary or desirable to change a lock so that previously operable keys are no longer effective to unlock the door. This is particularly important in offices and other commercial installations where periodic rekeying of the lock is desired to prevent unauthorized access by persons, such as former employees, or others, who have acquired keys to the relevant doors. Such alteration of the lock is made much simpler where the lock is an interchangeable core lock. An example of a commonly accepted interchangeable core lock is illustrated in the Schlage Lock Company's U.S. Pat. No. 4,123,926. Such interchangeable core locks allow the locksmith to prepare a set of lock cores keyed to a new key at his shop; the newly rekeyed lock cores can then be inserted into the locksets at the worksite. This method is more efficient than requiring the locksmith to do the rekeying of each lock while on location at the worksite.

A known device for use in disassembly of a interchangeable core cylinder lock is described in U.S. Pat. No. 4,680,860 to Detloff. The device described in the patent is designed to allow the locksmith to discover the control key codes for the lock by allowing the locksmith to capture the pins, in their correct sequence, which are removed from a lock core. The pins are captured in a series of pin retaining chambers, one for each pin. In practice, it has been found that this device is tedious to use, as it requires an overly complicated series of steps to mount the lock core into the core receiving channel. Specifically, it is necessary to pivot the members of the device together and lock them together using a latching means, whereupon, the lock core may be inserted into a channel formed between the two members, and is then secured with a set screw. Removal of the lock core from the device requires the opposite series of steps, including, releasing the set screw, carefully sliding the two members relative to each other to release the latching mechanism, and pivoting the members apart so that the core can be removed from the channel. The core must then be transferred to another device for repinning the core with new lock pins and for capping the lock with the necessary cap to retain the newly installed lock pins.

Another known device is used simply for removal of pins. In these devices, a block is provided with a channel of a cross-sectional shape suitable for confining a lock core (such as a Figure "8" in cross-sectional shape for Schlage® lock cores) machined into the top of the block. The channel thus has an open upper end. A series of bores extend perpendicularly from the channel downwardly to a hollowed out dump area in the block. A lock core can be mounted in the block by sliding it into the channel, in an upside down orientation, so the lock pins can be removed from the lock core by punching them out from the upwardly facing lower face of the lock core with an ejector pin.

A device for the repinning and recapping of pins is a similar block with a core holding channel (for example, with a Figure "8" cross sectional shape). One or more tops may be provided to the channel in this device so that the channel is completely enclosed within the block without any open upper end. The tops have a plurality of pinning bores extending from the upper outer surface of the block to the core holding channel. This block is used for the repinning and recapping of an interchangeable core by sliding the lock core into the passage in an upright orientation, so that lock pins can be dropped through the pinning bores into the lock core at the correct locations. A lock cap (a curved metal cover) is then pressed into place in the lock core to hold the newly installed lock pins in place.

SUMMARY OF THE INVENTION

It is an object of the invention to provide a single device usable by the locksmith for pin removal and decoding, and core repinning and recapping.

It is an object of the invention to provide such an apparatus which will be simple and easy to use.

These objects, and others, are met by a lock core repinning apparatus, comprising: a body having a central core receiving channel extending therethrough; a plurality of cylindrical bores extending from an upper surface of said body through the body and perpendicularly intersecting the core receiving channel; a receptacle receiving channel in the body located below and in communication with the core receiving channel; and a removable pin receiving receptacle slidably received in the receptacle receiving channel, the pin receiving receptacle having a plurality of pin receiving pockets extending perpendicularly from the core receiving channel of the body generally in alignment with the cylindrical bores. The pin receiving receptacle may take either of two forms: a hinged form that opens like a book to reveal the captured lock pins, or a solid block form that contains slots in which the captured pins are visible. Specifically, the "book" embodiment comprises two cover plates hinged together, the cover plates each having a plurality of grooves formed in their faces so that when the plates are pivoted together, the grooves on the faces meet to form the plurality of pin receiving pockets. The "solid block" Embodiment comprises a solid body having the plurality of pin receiving pockets formed therein, with slots extending laterally from the pin receiving pockets through the solid body to an outer surface of the solid body.

Preferably, the core receiving channel has a length and a diameter which varies over its length from a larger diameter at one end of the channel to a smaller diameter at the other end of the channel, thereby providing a core receiving channel sized to receive a lock core therein from one end only. In a most preferred embodiment, the apparatus further includes means for retaining the pin receiving receptacle in a predetermined position in the receptacle receiving channel, such as a spring loaded ball provided in the body, with a portion of the ball extending into the receptacle receiving channel, the ball being displaceable into a recess in the body when the pin receiving receptacle is inserted into the receptacle receiving channel, the pin receiving receptacle having a cavity positioned to receive the spring loaded ball when the pin receiving receptacle is located in a predetermined position in the receptacle receiving channel.

Other objects, aspects and features of the present invention in addition to those mentioned above will be pointed out in or will be understood from the following detailed description provided in conjunction with the accompanying drawings.

BRIEF DESCRIPTION OF THE DRAWINGS

FIG. 6 is a front elevation view of the assembled interchangeable core lock repinning apparatus of FIG. 2, with a partial cross-sectional view thereof.

FIG. 7 is a side cross-sectional view of the assembled interchangeable core lock repinning apparatus of FIG. 2.

FIG. 8 is a perspective view of an interchangeable core lock repinning apparatus in accordance with a second embodiment of the invention.

FIG. 9 is top plan view showing a second embodiment of a removable pin receiving receptacle, which is used in the interchangeable core lock repinning apparatus of FIG. 8.

FIG. 10 is a perspective exploded view of the second embodiment of a removable pin receiving receptacle shown in FIG. 9.

DETAILED DESCRIPTION OF THE PREFERRED EMBODIMENT

Figure 1:
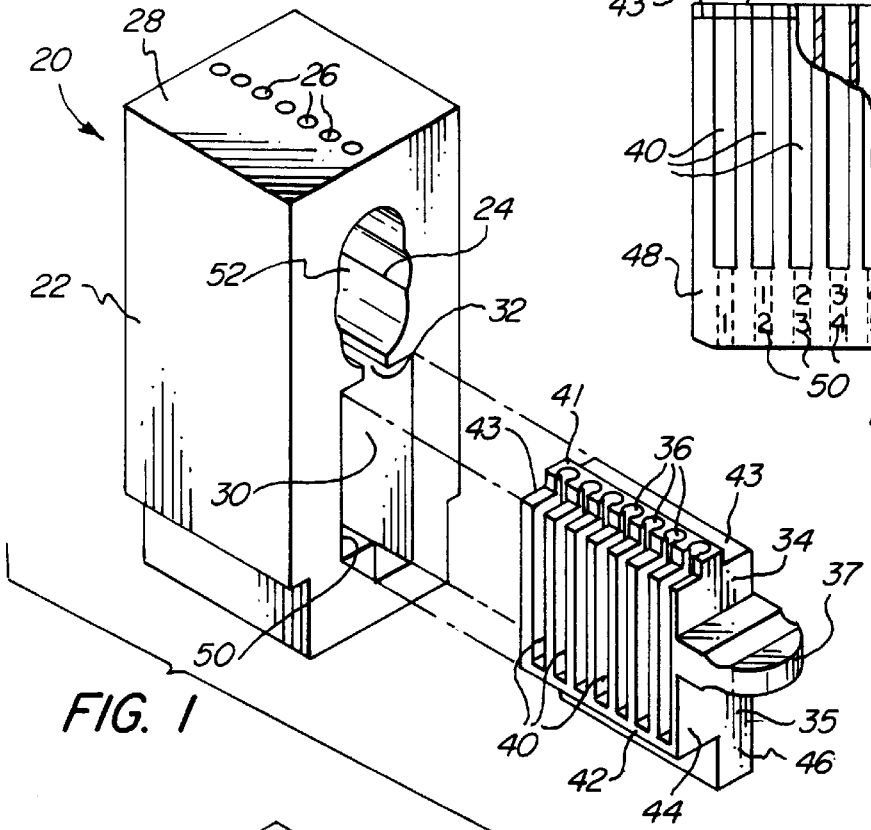
FIG. 1 a perspective exploded view of an interchangeable core lock repinning apparatus in accordance with one embodiment of the invention.

Referring now to FIGS. 1–7, a interchangeable core lock repinning apparatus 20 in accordance with a first "solid block" embodiment of the invention is shown. Apparatus 20 comprises a body 22 having a central core receiving channel 24 extending therethrough. A plurality of cylindrical bores 26 extend from an upper surface 28 of the body 22 through the body and perpendicularly intersect the core receiving channel 24. Preferably there are seven such bores, to accommodate locks made by different lock manufacturers. A receptacle receiving channel 30 is located in the body 22 below and in communication with the core receiving channel 24 via a slot 32. A removable pin receiving receptacle 34 is slidably received in the receptacle receiving channel 30. The pin receiving receptacle 34 has a plurality of pin receiving pockets 36 extending perpendicularly from the core receiving channel 24 of the body 22 generally in alignment with the cylindrical bores 26.

Figure 3:
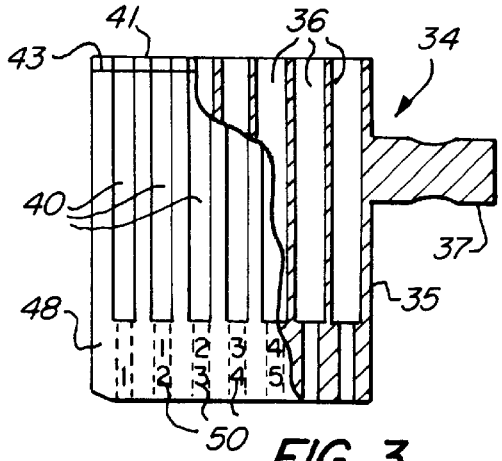
FIG. 3 is a side elevation view with partial cross section showing an embodiment of a removable pin receiving receptacle used in the interchangeable core lock repinning apparatus of FIG. 1.
Figure 4:
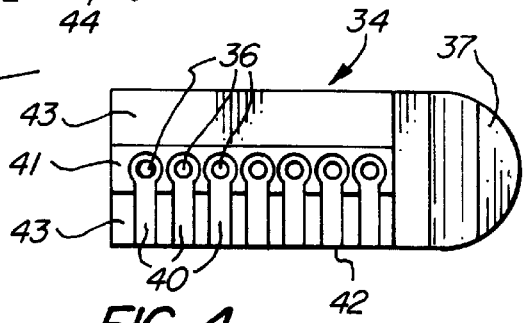
FIG. 4 is a top plan view of the removable pin receiving receptacle of FIG. 3.
Figure 2:
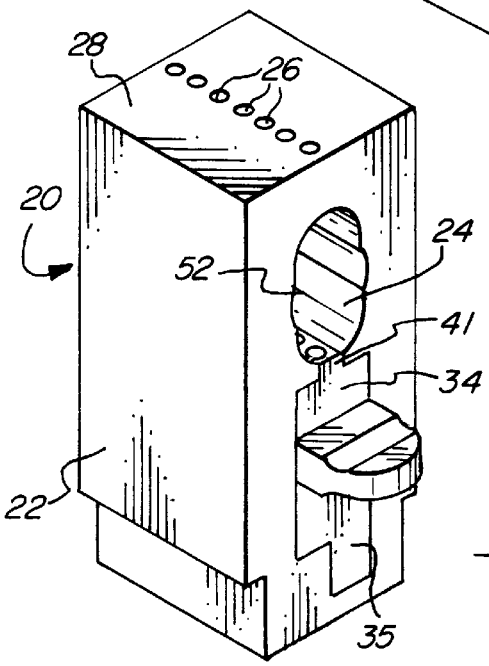
FIG. 2 is a perspective assembled view of the interchangeable core lock repinning apparatus of FIG. 1.
Figure 5:
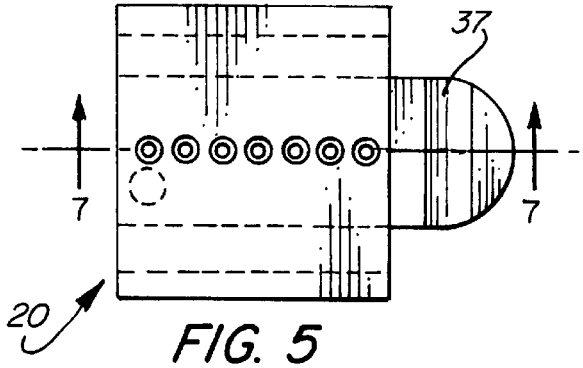
FIG. 5 is a top plan view of the assembled interchangeable core lock repinning apparatus of FIG. 2.

In the embodiment shown in FIGS. 1–7, the pin receiving receptacle 34 is a solid block 35 with a tab handle 37. Receptacle 34 has a plurality of pin receiving pockets 36 formed therein. Preferably there are seven such pockets 36. Slots 40 extend laterally from the pin receiving pockets 36 through the solid block 35 to an outer side surface 42 of the solid body. Lock pins removed from a lock core are visible through the slots 40, and can be manipulated with a suitable slender tool that can be fit through a slot 40. Receptacle 34 has a central section 41 that extends above the upper surface 43 of receptacle 34 and fits into the slot 32 in body 22, to position the pockets in alignment with a close proximity to lock pins to be removed from a lock core fitted into core receiving channel 24. Receptacle 34 is provided with an asymmetric cross-sectional shape, shown in FIG. 1 as a rectangle 44 with a downwardly extending leg 46. The receptacle receiving channel 30 is provided with the complementary cross-sectional shape so that receptacle 34 fits into channel 30. The use of the asymmetric shape insures that the receptacle may be positioned relative to the body 22 in only one way. This reduces the chance of error in orientation of the receptacle 34 when it is inserted into the channel 30. Preferably, numbering 50 is applied to the face 48 of leg 46 so that the locksmith can identify which position in the lock each removed lock pin came from. Thus, as seen in FIG. 3, numbering is provided below pockets 36. In the preferred embodiment, there are numbering of pockets one to seven, with an alternate numbering of one to six, to accommodate various lock styles.

Preferably, the core receiving channel 24 has a length and a diameter which varies over its length from a larger diameter at its core receiving end 52 of the channel 24 to a smaller diameter at the other end 54 of the channel 24. The tapered diameter of the core receiving channel insures that a lock core can be fit into the core receiving channel 24 from the core receiving end 52 only. Attempts to insert a core into the other end 54 of channel 24 will be frustrated because the end 54 is sized to be too small to permit insertion of the core. The benefit of the tapered core receiving channel 52 and the asymmetric receptacle 34 is that there is only one possible orientation of the lock core and the receptacle 34. This ensures consistency and accuracy in lock decoding, and reduces or eliminates potential problems of lock core jamming in the core receiving channel 24.

Means for retaining the pin receiving receptacle 34 in a predetermined position in the receptacle receiving channel 30 are provided. This insures that the receptacle 34 can be consistently properly located with tactile feedback that the receptacle 34 is properly positioned. Preferably, as best seen in FIG. 6, the retaining means comprises a spring loaded ball 56 provided in the body 22, with a portion 58 of the ball extending into the receptacle receiving channel 30. Ball 56 is displaceable into a recess 60 in the body 22 when the pin receiving receptacle 34 is inserted into the receptacle receiving channel 30. The pin receiving receptacle 34 has a cavity 62 positioned and sized to receive the spring loaded ball 56 when the pin receiving receptacle 34 is located in a desired, predetermined position in the receptacle receiving channel 30. The desired predetermined position is the one in which the cylindrical bores 26 of the body 22 are aligned with the pin receiving pockets 36 of the receptacle 34.

Referring now to FIGS. 8–10, the interchangeable core lock repinning apparatus 120 is shown with the "book" embodiment of the receptacle 134. Receptacle 134 comprises two cover plates 180 and 182. Plates 180 and 182 are hinged together by a hinge pin 184 and hinge pin holders 186 on plate 180 and hinge pin holder 188 on plate 182. Cover plates 180 and 182 each have a plurality of grooves 190 formed in their mating faces 192 and 194 respectively, so that when the plates 180 and 182 are pivoted so that faces 192 and 194 are placed next to each other, the grooves 190 on the faces 192 and 194 meet to form a plurality of pin receiving pockets 136. This embodiment will typically lack the tab handle 37 used in the embodiment of FIGS. 1–7, as the user can make use of the extending hinge pin holders 186 and 188 to grip the receptacle 134 and remove it or insert it in the body 22. Preferably, the two cover plates 180 and 182 have extending sections 196 and 198 that meet when the plates are pivoted so that faces 192 and 194 are placed next to each other, to form a central section 141 that extends upwardly so that the pockets 136 are close by the cylindrical bores 26 in the body 22. Apart from the differences in the receptacle as just described in this paragraph, the embodiment shown in FIGS. 8–10 is identical to the embodiment described with reference to FIGS. 1–7, and in particular, the body 22 will be identical in both cases.

Preferably, the parts of the apparatus described above are fabricated from metal, most preferably steel, although other materials have the necessary strength and durability, including plastic materials, alloys, etc. may be used.

The use of the apparatus 22 is generally as follows. A lock core is inserted into the core receiving channel 24 from its core receiving end 52 in an upside down orientation. An ejector pin is inserted through one or more of the cylindrical bores 26 to press out pins from the lock core in the position where new pins are desired. These pins drop from the core through into the pin receiving pockets 36 or 136 of the pin receiving receptacle 34 or 134, respectively. The pin receiving receptacle 34 or 134 is then removed from the body 22. If the locksmith desires to decode the lock, the pins are then inspected. In the case of receptacle 34, the pins are inspected via the slots 40; in the case of receptacle 134, the "book" is opened and the pins are visible in their entirety in one of the grooves 190. If no lock decoding is involved, the pins are simply removed and recycled or disposed of. The lock core can then be repinned, by inserting it into the core receiving channel 24 from its core receiving end 52 in a right-side up orientation. New lock pins and springs are then inserted through the cylindrical bores 26 and seated in the lock core. When this operation is complete, oversized cylinder caps are inserted into each cylindrical bore (26) to lock the pin stacks in each chamber. The oversized caps are seated into each of the cylinders' cylindrical bores with a capping instrument that forces or plugs each cylinder in such fashion so that the loaded core of pins and springs stay securely in the cylinder.

Accordingly, the present invention provides an all-in-one tool allowing pin removal, pin decoding, repinning, and recapping of an interchangeable lock core; it is simple and convenient to use, and allows for accurate pin positioning.

What is claimed is:

1. A lock core repinning apparatus, comprising:

a body having a central core receiving channel extending therethrough;

a plurality of cylindrical bores extending from an upper surface of said body through said body and perpendicularly intersecting said core receiving channel;

a receptacle receiving channel in said body located below and in communication with said core receiving channel;

a removable pin receiving receptacle slidably received in said receptacle receiving channel, said pin receiving receptacle having a plurality of pin receiving pockets extending perpendicularly from said core receiving channel of said body generally in alignment with said cylindrical bores said receptacle including an extension received in a slot which interconnects said channels.

2. A lock core repinning apparatus in accordance with claim 1, wherein said removable pin receiving receptacle comprises two cover plates hinged together, said cover plates each having a plurality of grooves formed in their faces so that when the plates are pivoted together, the grooves on the faces meet to form said plurality of pin receiving pockets.

3. A lock core repinning apparatus in accordance with claim 1, wherein said removable pin receiving receptacle comprises a solid body having said plurality of pin receiving pockets formed therein, with slots extending laterally from said pin receiving pockets through said solid body to an outer surface of said solid body.

4. A lock core repinning apparatus in accordance with claim 1, wherein said core receiving channel has a length and a diameter which varies over its length from a larger diameter at one end of said channel to a smaller diameter at the other end of said channel.

5. A lock core repinning apparatus in accordance with claim 4, wherein said core receiving channel is sized to receive a lock core therein from one end only.

6. A lock core repinning apparatus in accordance with claim 1, further comprising means for retaining said pin receiving receptacle in a predetermined position in said receptacle receiving channel.

7. A lock core repinning apparatus in accordance with claim 6, wherein said means for retaining comprises a spring loaded ball provided in said body, with a portion of said ball extending into said receptacle receiving channel, said ball being displaceable into a recess in said body when said pin receiving receptacle is inserted into said receptacle receiving channel, said pin receiving receptacle having a cavity positioned to receive said spring loaded ball when said pin receiving receptacle is located in a predetermined position in said receptacle receiving channel.

8. A lock core repinning apparatus, comprising:

a body having a central core receiving channel extending therethrough;

a plurality of cylindrical bores extending from an upper surface of said body through said body and perpendicularly intersecting said core receiving channel;

a receptacle receiving channel in said body located below and in communication with said core receiving channel;

a removable pin receiving receptacle slidably received in said receptacle receiving channel, said pin receiving receptacle being formed of two cover plates hinged together, said cover plates each having a plurality of grooves formed in their faces so that when the plates are pivoted together, the grooves on the faces meet to form a plurality of pin receiving pockets extending perpendicularly from said core receiving channel of said body generally in alignment with said cylindrical bores.

9. A lock core repinning apparatus in accordance with claim 8, wherein said core receiving channel has a length and a diameter which varies over its length from a larger diameter at one end of said channel to a smaller diameter at the other end of said channel.

10. A lock core repinning apparatus in accordance with claim 9, wherein said core receiving channel is sized to receive a lock core therein from one end only.

11. A lock core repinning apparatus in accordance with claim 8, further comprising means for retaining said pin receiving receptacle in a predetermined position in said receptacle receiving channel.

12. A lock core repinning apparatus in accordance with claim 11, wherein said means for retaining comprises a spring loaded ball provided in said body, with a portion of said ball extending into said receptacle receiving channel, said ball being displaceable into a recess in said body when said pin receiving receptacle is inserted into said receptacle receiving channel, said pin receiving receptacle having a cavity positioned to receive said spring loaded ball when said pin receiving receptacle is located in a predetermined position in said receptacle receiving channel.

13. A lock core repinning apparatus, comprising:

a body having a central core receiving channel extending therethrough;

a plurality of cylindrical bores extending from an upper surface of said body through said body and perpendicularly intersecting said core receiving channel;

a receptacle receiving channel in said body located below and in communication with said core receiving channel;

a removable pin receiving receptacle slidably received in said receptacle receiving channel, said pin receiving receptacle being a solid body having a plurality of pin receiving pockets formed therein, with slots extending laterally from said pin receiving pockets through said solid body to an outer surface of said solid body, said pin receiving pockets extending perpendicularly from said core receiving channel of said body generally in alignment with said cylindrical bores.

14. A lock core repinning apparatus in accordance with claim 13, wherein said core receiving channel has a length and a diameter which varies over its length from a larger diameter at one end of said channel to a smaller diameter at the other end of said channel.

15. A lock core repinning apparatus in accordance with claim 14, wherein said core receiving channel is sized to receive a lock core therein from one end only.

16. A lock core repinning apparatus in accordance with claim 13, further comprising means for retaining said pin receiving receptacle in a predetermined position in said receptacle receiving channel.

17. A lock core repinning apparatus in accordance with claim 16, wherein said means for retaining comprises a spring loaded ball provided in said body, with a portion of said ball extending into said receptacle receiving channel, said ball being displaceable into a recess in said body when said pin receiving receptacle is inserted into said receptacle receiving channel, said pin receiving receptacle having a cavity positioned to receive said spring loaded ball when said pin receiving receptacle is located in a predetermined position in said receptacle receiving channel.

* * * * *